US005775971A

United States Patent [19]

Brown

[11] Patent Number: 5,775,971

[45] Date of Patent: Jul. 7, 1998

[54] THREE-DIMENSIONAL FOLDED CARTON ACTION FIGURES

[76] Inventor: Jerry L. Brown, 683 N. Shore Dr., Forest Lake, Minn. 55025

[21] Appl. No.: 644,046

[22] Filed: May 9, 1996

[51] Int. Cl.[6] ..... A63H 3/08; A63H 3/46

[52] U.S. Cl. ..... 446/376; 446/388

[58] Field of Search ..... 446/97, 98, 77–80, 446/387, 388, 376, 390

[56] References Cited

U.S. PATENT DOCUMENTS

| | | | |
|---|---|---|---|
| 554,410 | 2/1896 | Bailey | 446/387 |
| 628,239 | 7/1899 | Cohn | 446/387 X |
| 1,181,421 | 5/1916 | Apt | 446/87 |
| 1,544,645 | 7/1925 | Johnson | 446/387 |
| 2,203,128 | 6/1940 | Cairo | 446/376 X |
| 2,365,098 | 2/1944 | Nudelman . | |
| 3,914,897 | 10/1975 | Schoeman et al. | 446/387 X |
| 4,057,247 | 11/1977 | Morrison | 446/326 X |
| 5,386,656 | 2/1995 | Bergman . | |
| 5,458,521 | 10/1995 | Todd | 446/80 X |

FOREIGN PATENT DOCUMENTS

| | | | |
|---|---|---|---|
| 490489 | 2/1954 | Italy | 446/376 |

*Primary Examiner*—Mickey Yu
*Attorney, Agent, or Firm*—Kinney & Lange, P.A.

[57] ABSTRACT

A three-dimensional action figure is formed from flat sheet material. The torso of the action figure is a folded carton formed of sheet material. The action figure includes jointed movable members which are pivotally attached to the torso by means of a novel joint. The joint allows the movable members to pivot 360° without disengagement from the torso, and with no additional support or connection such as a rivet. The characters may include animal, cartoon or human characters.

20 Claims, 8 Drawing Sheets

THREE-DIMENSIONAL FOLDED CARTON ACTION FIGURES

BACKGROUND OF THE INVENTION

The present invention relates to three-dimensional action figures. In particular, the present invention relates to three-dimensional human, animal or cartoon action characters formed from flat sheet material having torsos formed from folded cartons and jointed movable members which are assembled for oscillatory or pivotal movement with no eyelet, rivet or other added support for the movement.

There are many kinds of printed paper characters that are die-cut and tabbed, glued, or riveted together to form three-dimensional characters which represent real or imaginary figures. In general, such printed toys may be divided into two groups. The first group includes flat paper character dolls that are die-cut and punched out of cardboard or similar material and inserted into a base member to allow the doll to stand upright. These dolls often have accessories such as clothes or weapons that are attached by tabs onto the core character. The second group of printed toys includes pop-up novelty cards, such as shown in U.S. Pat. No. 5,386,656, which incorporate the character doll into an action background setting that gives the flat character an illusion of dimension.

While prior art paper dolls have been successful, they are suffer from several deficiencies. Flat paper character dolls that are die-cut or punched out of cardboard or similar material and inserted into a base member to allow them to stand up right are generally presented in a fixed pose which may not be varied by the user, typically a child. The fixed pose limits the creative uses of the characters. The pop-up novelty cards, such as depicted in U.S. Pat. No. 5,386,656 are similarly provided in a fixed pose and are further typically permanently secured to a background action setting. In sum, the fixed poses of the prior art dolls limits the play potential for the characters and thus limits their attractiveness as useful toys. Additionally, the flat paper character dolls and even the pop-up novelty cards do not adequately or convincingly provide a sense of three-dimensionality, and are therefore not as attractive as toys. Finally, the two-dimensionality of the prior art figures also results in figures which are relatively flimsy and unsturdy. Because the figures are made out of thin sheet material which is typically flexible or bendable, the figures tend to bend and fold easily. The flexibility of the figures greatly reduces their durability and stability, and thus reduces their usefulness as toys.

Action figures which utilize movable joints are also known. For example, U.S. Pat. No. 2,365,098 discloses a cardboard action figure with a movable joint. However, the cardboard figures disclosed in U.S. Pat. No. 2,365,098 generally display only a two-dimensional quality, like the flat paper characters and pop-up novelty figures described above. In particular, the figures disclosed by U.S. Pat. No. 2,365,098 are assembled from sections of cut or punched out cardboard sections held together by friction and locking joints. In order to stand, the figures have a general inverted U or V-shape which gives them sufficient width to stand when placed on a table or other supporting surface. However, the figures are only viewable from the sides of the figures, and not the front or rear. If viewed from the front or rear, the figures appear only as two spaced-apart pieces of cardboard and it is not possible to discern who or what the character is. Essentially, U.S. Pat. No. 2,365,098 replaces the base member of the flat paper character dolls with slightly spaced identical images of the figure to provide sufficient width to allow the figure to stand.

The joints used to allow movement in the figures of U.S. Pat. No. 2,365,098 utilize a slit in the stationary member and a radial slit in the movable member, such that the slit in the movable member interlocks with the slit in the stationary member and thereby allows the movable member to pivot relative to the stationary member. The joint of U.S. Pat. No. 2,365,098 only allows a limited range of movement for the movable member, however. If the relative rotation of the members exceeds a predetermined degree of rotation, the members become disengaged. Clearly, disengagement of the movable members (typically arms and legs) is not conducive to use of the character.

Given the problems and limitations of the prior art, a need exists for toy action characters formed of sheet material which provide an improved three-dimensional appearance regardless of the angle from which the character is viewed. There is also a need for a joint for use with such characters which allows movable members such as arms and legs to pivot freely (i.e., 360 degrees) without causing disengagement of the members. Further, a design which provides greater rigidity to the cardboard action characters is needed, to provide the characters with greater durability and stability.

SUMMARY OF THE INVENTION

The present invention provides three-dimensional toy characters formed of sheet material. The toy characters have three-dimensional "folded carton" torso members formed of folded sheet material, and movable members formed of sheet material which are attached to the torso member by means of a novel joint.

The folded carton torso member provides a three-dimensional appearance regardless of the angle from which a character is viewed, and further allows the character to assume a wide variety of shapes.

The joint allows the movable members to pivot freely relative to the torso member without causing disengagement of the members and utilizes a crease in the movable member to urge the movable member into contact with the torso member. The joint utilizes a unique head portion having at least two tab members which engage a circular opening in the torso member. In addition, the construction of the characters of the present invention creates greater structural rigidity which gives the characters greater durability and stability.

BRIEF DESCRIPTION OF THE DRAWINGS

FIG. 12 is a plan view of unassembled and unfolded components of a cartoon character.

DETAILED DESCRIPTION OF THE PREFERRED EMBODIMENTS

As shown in the Figures and described below, the present invention relates to three-dimensional human, animal or cartoon action characters having a folded carton torso formed from flat sheet material, as well as jointed movable members which are assembled with no eyelet, rivet or other added support to allow movement of the joint. The type of material used to form the characters may include any type of sheet material which may be cut and folded including, but not limited to, paper, cardboard, plastic, and metal.

The characters utilize sheet material folded to form a carton and thereby create a three-dimensional body or torso member. The folded carton representing the body or torso of the character may be formed to any desired shape to simulate the body or torso of the character to be constructed. The folded carton torso may be retained in its folded condition by any means known in the art, including "slot and tab" connections or glue. Other mechanical fastening means may also be used.

In three-dimensional characters representing persons or animals, the characterization or illusion of movement is provided in the form of jointed and pivotal legs, arms, jaws or other body members, making it possible to move the members to one position or another according to the pose or movement the character is intended to assume or illustrate. In each instance, the folded carton torso member of the three-dimensional character creates sufficient leg spread to allow the character to stand when placed on a table or other supporting surface.

Figure 10:
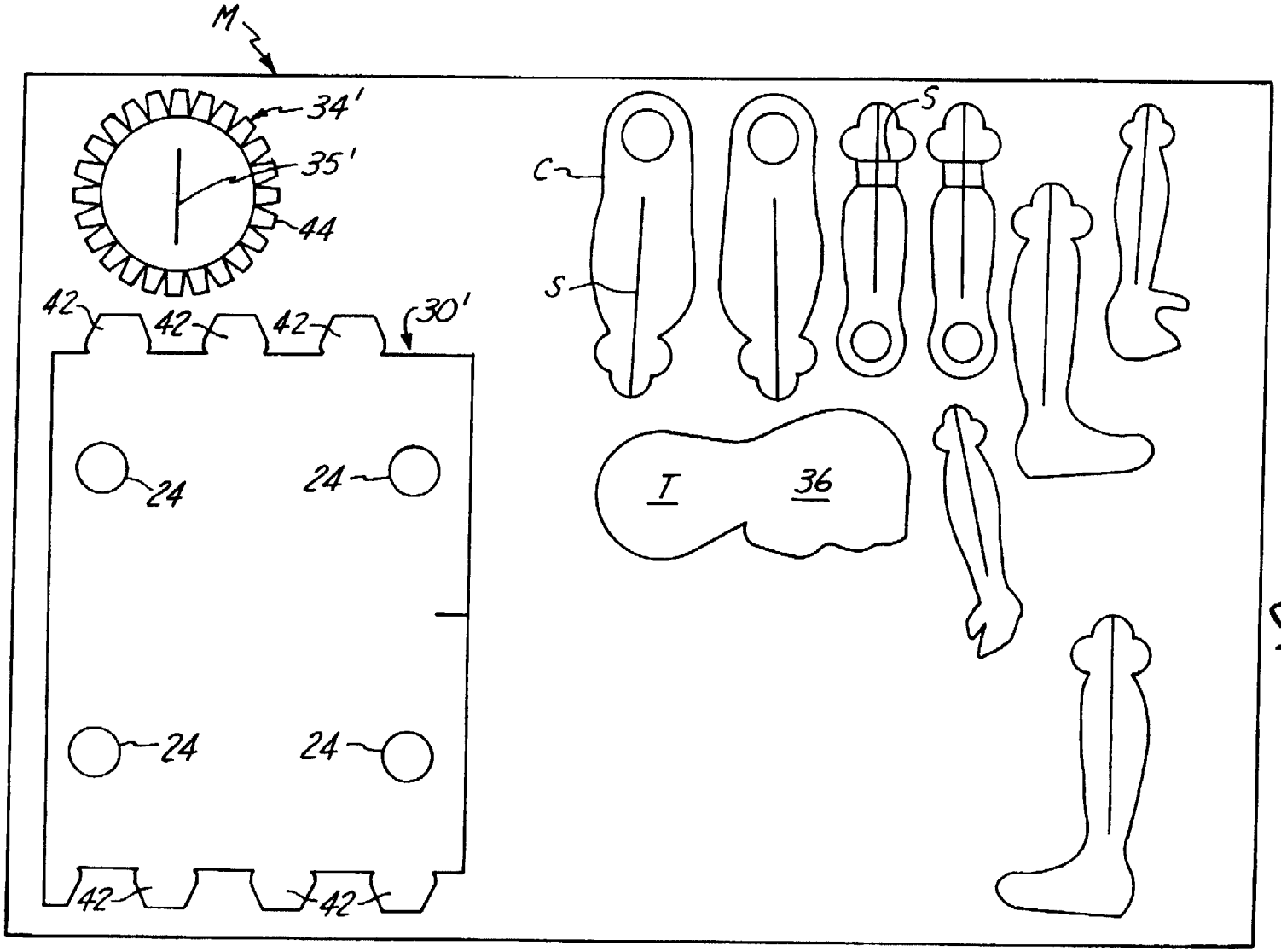
FIG. 10 is a plan view of unassembled and unfolded components of a human character having a cylindrically-shaped torso.
Figure 11:
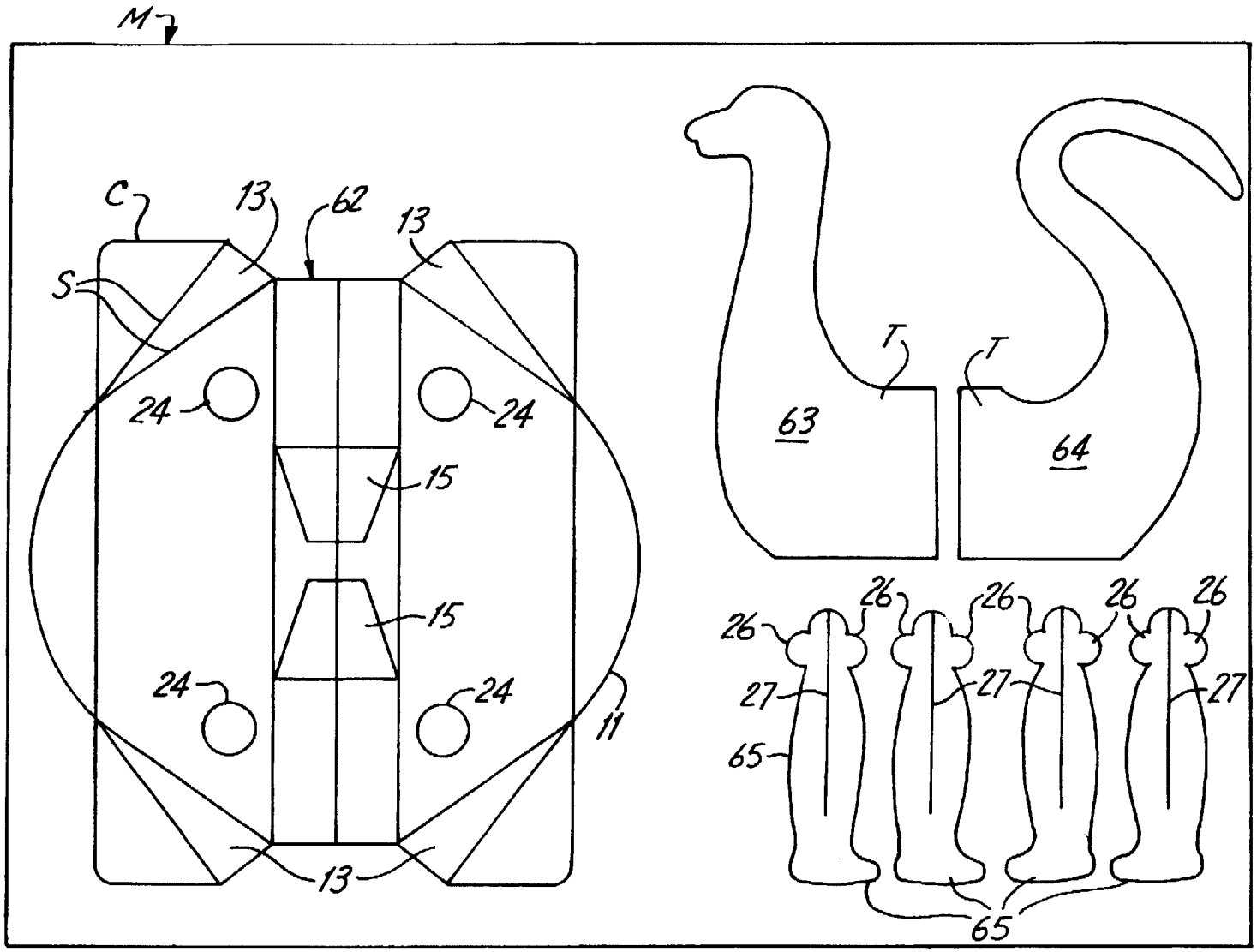
Figure 12:
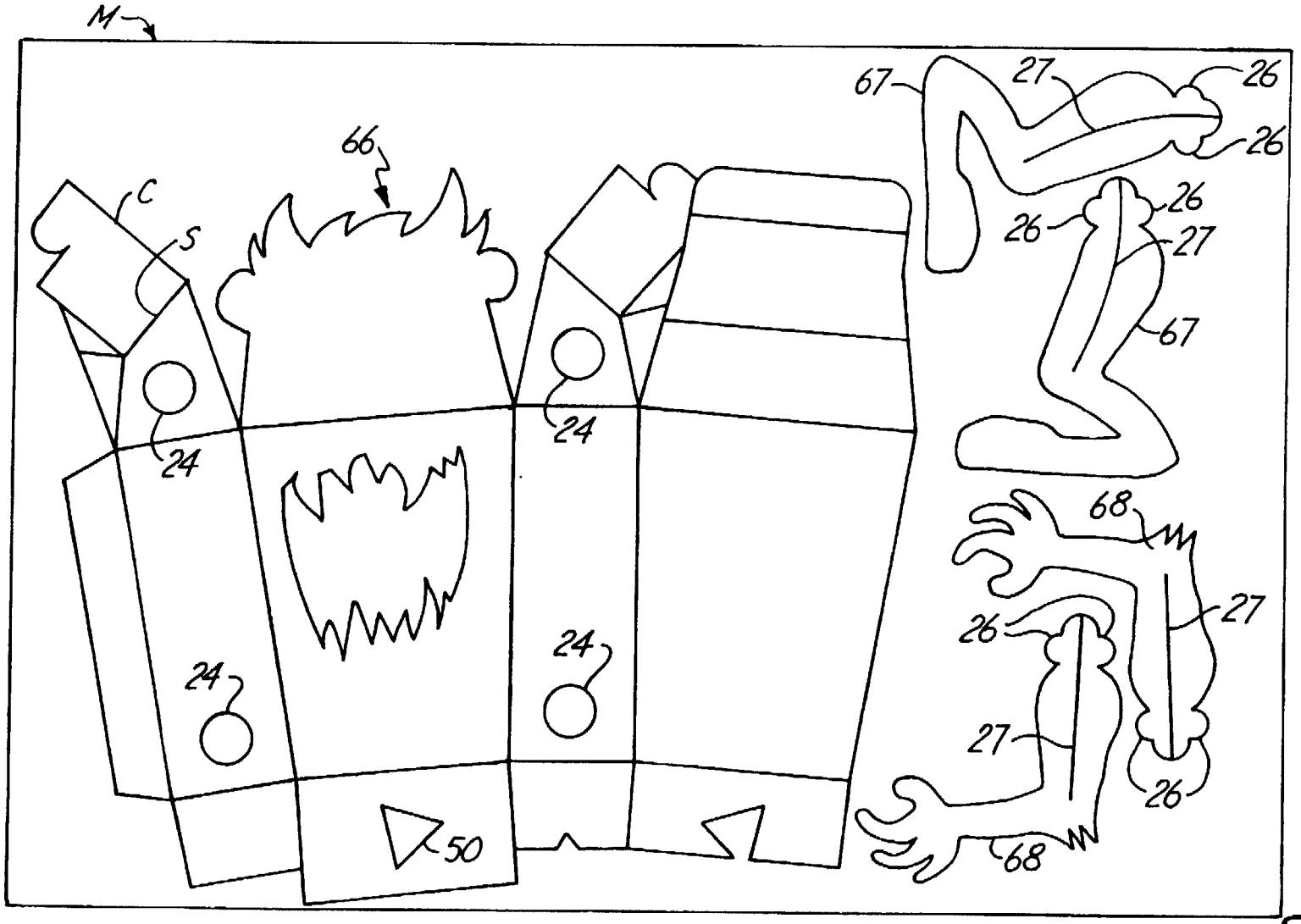
FIG. 12 is a plan view of unassembled and unfolded components of a dinosaur character.

The characters of the present invention may take many different forms, and are limited only by the designer's imagination. Therefore, the specific characters described herein are to be considered examples, and should not be construed as limiting the scope of the invention. Several examples of the types of characters encompassed by the present invention are shown in the Figures. FIGS. 1–4 illustrate a dragon and elements of its construction. FIGS. 5–10 illustrate a human character. FIGS. 11 and 12 illustrate a dinosaur and a cartoon character, respectively, in an unassembled condition.

Figure 1:
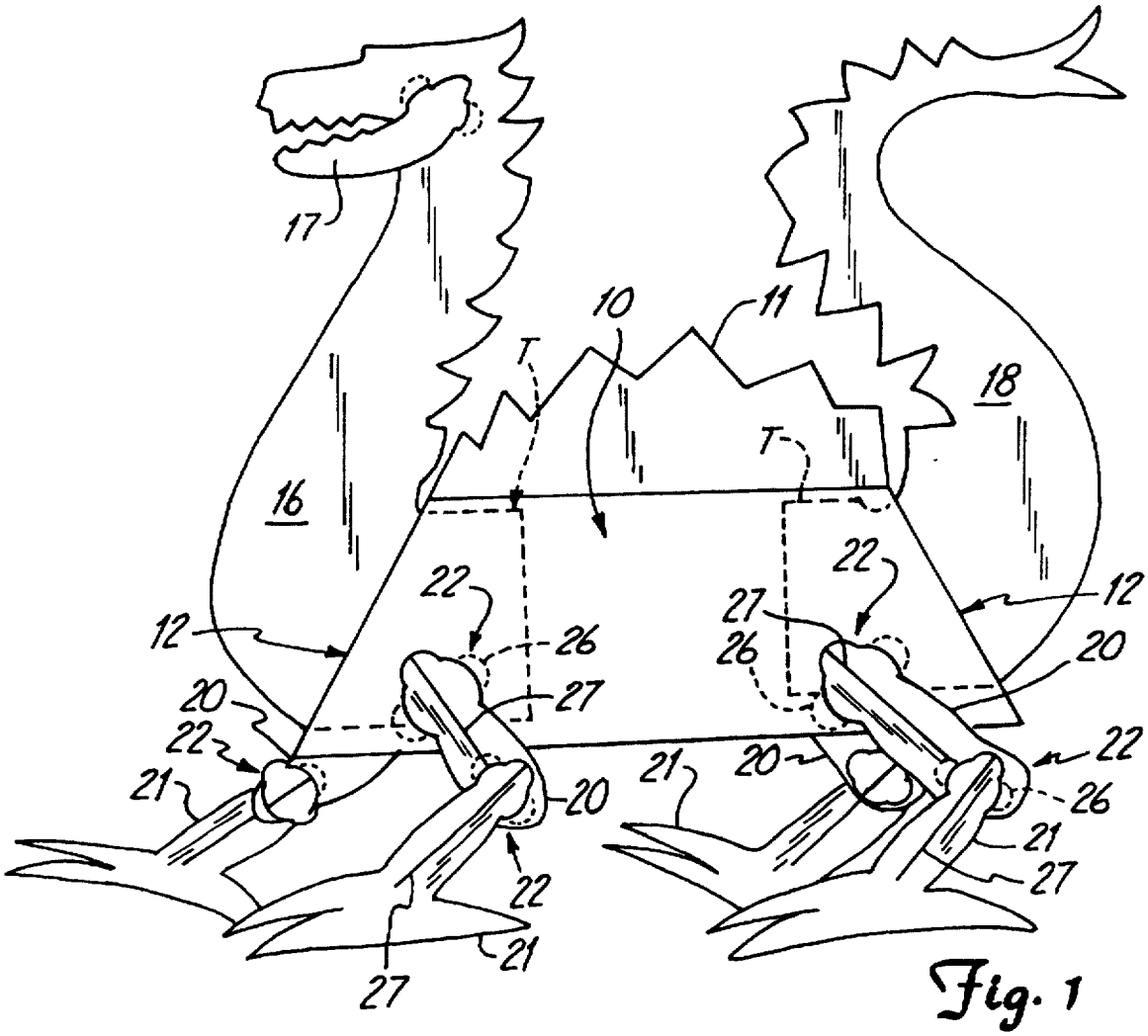
FIG. 1 is a side elevational view of a dragon character utilizing a folded carton torso and the joint of the present invention.
Figure 2:
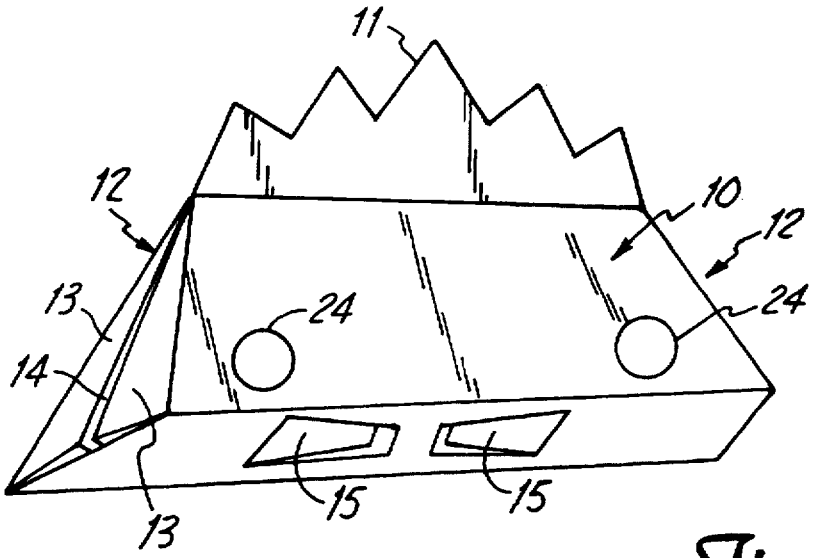
FIG. 2 is a perspective view of the folded carton torso member of the character of FIG. 1.

As an example of the construction utilized by the toy characters of the present invention, a dragon character is illustrated in FIGS. 1–4. As seen in FIG. 1, the dragon character possesses an elongated torso member 10 formed of a folded carton having a triangular cross-section to approximate an animal torso. The torso member 10 is best seen in FIG. 2. The folded carton torso member 10 includes a top surface 11 provided with a shape appropriate to the particular character to be represented (in this example a dragon). The torso 10 includes end portions 12 having folded flaps 13 which form a slot 14 in end portion 12. Preferably, folded carton torso member 10 is designed to create one or more slots 14 to receive any members (such as head and neck 16 and tail 18) which are formed of sheet material and which are provided with a tab "T". Cut-outs 15 are provided such that the cut-outs 15 may be bent into torso 10 to lend additional internal support to torso 10. To complete the character, the dragon further includes a head and neck 16, jaw 17, tail 18, upper legs 20, and lower legs 21. All members of the character are formed of a flat sheet material like the material used to form the torso 10.

Head and neck 16 and tail 18 are connected to torso 10 by sliding tab portions "T" into slots 14 formed in torso 10. As best seen in FIG. 2, the slots 14 in torso member 10 are formed between folded flaps 13 such that tab portions "T" of head and neck 16 and tail 18 are frictionally engaged in slots 14. Preferably, frictional engagement between tab "T" and slot 14 is sufficient to prevent unintended movement of the member, but also allows repositioning of the member if desired.

The dragon character includes several pivoting members. For example, upper legs 20 are pivotally connected to torso 10 by a joint 22. Similarly, lower legs 21 are pivotally connected to upper legs 20, and jaw 17 is pivotally connected to head and neck 16 by the joint 22.

In considering the joint 22 used to pivotally secure the limbs and other members to the torsos of the characters, the major or stationary member is designated as the supporting member, while the dependent or extending member is considered the movable member. For example, in the joint of upper leg 20 with torso 10, the stationary member is torso 10, while the movable member is upper leg 20. However, the joint 22 does not have to be adjacent the torso member, as illustrated by the "knee" joint 22 between upper leg 20 (the stationary member in this case) and lower leg 21 (the movable member). Similarly, the novel joint 22 could be an elbow or a jaw or any other joint where pivotal movement is desired.

Figure 3:
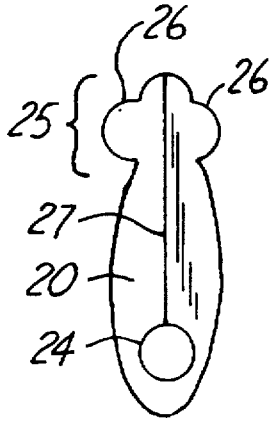
FIG. 3 is an elevational view of a movable member illustrating the head portion of the joint.

The joint will be described herein by reference to the dragon character of FIGS. 1–4. However, the description applies to use of the joint 22 in all variety of characters. Several assembled joints 22 are seen in FIG. 1, while the individual components are best seen in FIGS. 2 and 3. Each joint 22 includes a circular opening 24 in the supporting member (in this instance torso 10) at the pivot point of the joint, while the movable member (in this example, upper leg 20), includes a head portion 25 designed to interlock with the circular opening 24 in the supporting member 10. The individual elements of the joint 22 are more easily seen in FIG. 2 (depicting hole 24 in the supporting member and FIG. 3 (showing head portion 25 of the movable member).

As seen in FIG. 3, the head portion 25 of the movable member includes at least two tabs or ears 26 for engaging the opening 24 of the supporting member 10 and securing the movable leg member 20 to the supporting torso member 10. The tabs 26 are preferably diametrically opposed from each other. To assemble joint 22, the tabs 26 are bent and extended through the circular opening 24 such that they protrude beyond the diameter of the circular opening 24 and secure the movable leg member 20 to the supporting torso member 10.

Preferably, each movable member is further provided with a crease 27 extending longitudinally along the length of the movable member. The crease 27 provides the movable member with an additional three-dimensional effect by creating a more rounded, life-like movable member. The crease 27 also provides additional stability to the movable member, by increasing the stiffness of the movable member. Because the movable member is formed from a flat, often flexible, sheet material, the movable member is more prone to bending or flexing if not supported in some manner. The provision of the longitudinal crease 27 reduces the movable member's ability to flex or bend, and thus provides additional strength and stability to the character. Finally, the crease 27 helps maintain the integrity of the joint 22, by creating a "spring" effect which forces the tabs 26 on the head 25 of the movable member firmly into contact with the circumference of the circular hole 24 in the supporting member. The friction between the supporting member and the movable member helps retain the movable member in a desired position, and prevents the movable member from moving freely in an unintended manner.

The joint 22 as described prevents inadvertent separation of the supporting and movable members 10, 20, respectively, and allows the movable leg member 20 to rotate 360 degrees without disengaging from the supporting torso member 10. The joint 22 used to secure the movable members to the supporting member does not require any additional support, such as eyelets, rivets or the like. The joint 22 is therefore not only simple and mechanically efficient, but also allows a savings in material and the processing thereof, as a minimum amount of sheet material is required.

Typically, the unfolded torso and movable members may be cut from a single sheet of material, or multiple sheets of material if the size of the character so requires. Preferably, for ease of manufacture, only a single die-cut operation for cutting out the character and accompanying parts is required. As an example, the dragon character of FIG. 1 is shown in flat, uncut and unassembled form in FIG. 4. The various elements of the character are shown laid out on a sheet of material "M" as they would be laid out for a die-cutting operation. Preferably, the characters would also be provided with pre-printed features such as eyes, hair, clothes, etc. which are appropriate to the particular character. The heavy weighted lines, labeled C, indicate where the material is to be cut, while the thinner, lines labeled S, indicate score marks where the material is to be bent or folded. As an alternative to die-cutting the elements of the characters, the characters may be printed on the material to be cut out later by the user. For example, the unassembled and unfolded elements could be printed on a cereal box, and could be cut out after the contents of the box have been removed. The cut elements are then assembled as described below.

After cutting out the individual elements of the character, the folded carton torso 10 of the character would typically be assembled first. The torso 10 is folded along the lines "S" into a carton, and retains its three-dimensional shape by use of tabs, adhesive, tape, or other fastening means known in the art. The various movable members, such as upper legs 20 and lower legs 21 would then be attached to the proper stationary members by bending tabs 26 on the respective head portions 25 of the movable members and inserting the tabs 26 through the proper circular opening 24 provided in the stationary member. Other members, such as head and neck 16 or tail 18 are then inserted into slots 14 of torso 10 to complete construction of the character.

Figure 5:
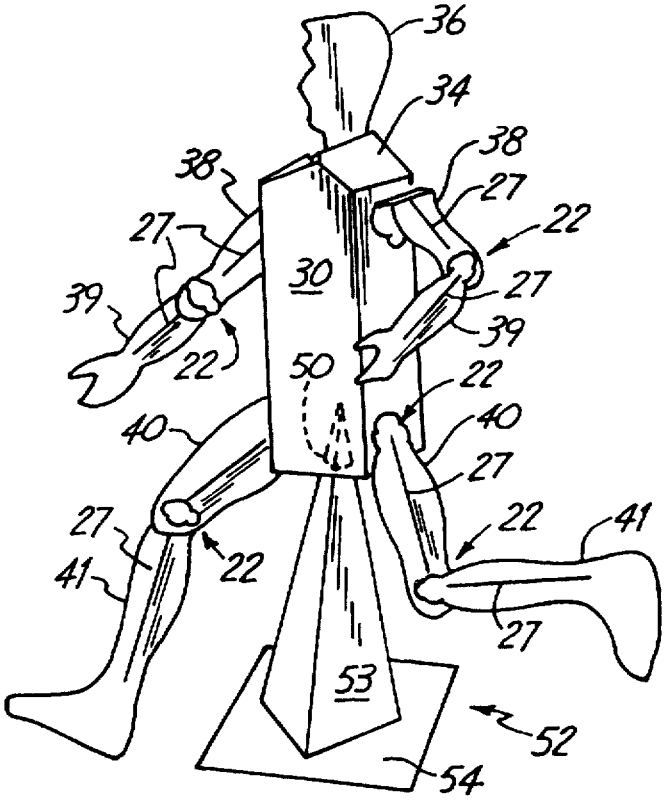
FIG. 5 is a perspective view of a human character utilizing a folded carton torso and the joint of the present invention.
Figure 6:
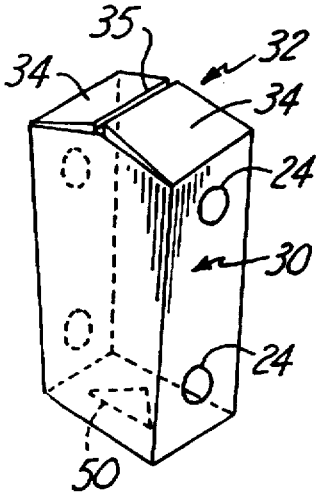
FIG. 6 is a perspective view of the folded carton torso member of the character of FIG. 5.
Figure 7:
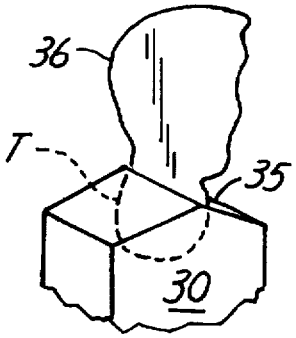
FIG. 7 is a perspective view of a head for a human character.
Figure 8A:
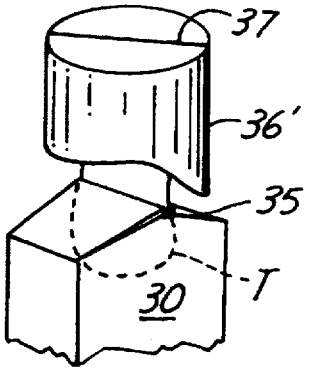
FIG. 8A is a perspective view of an alternative head for a human character.
Figure 4:
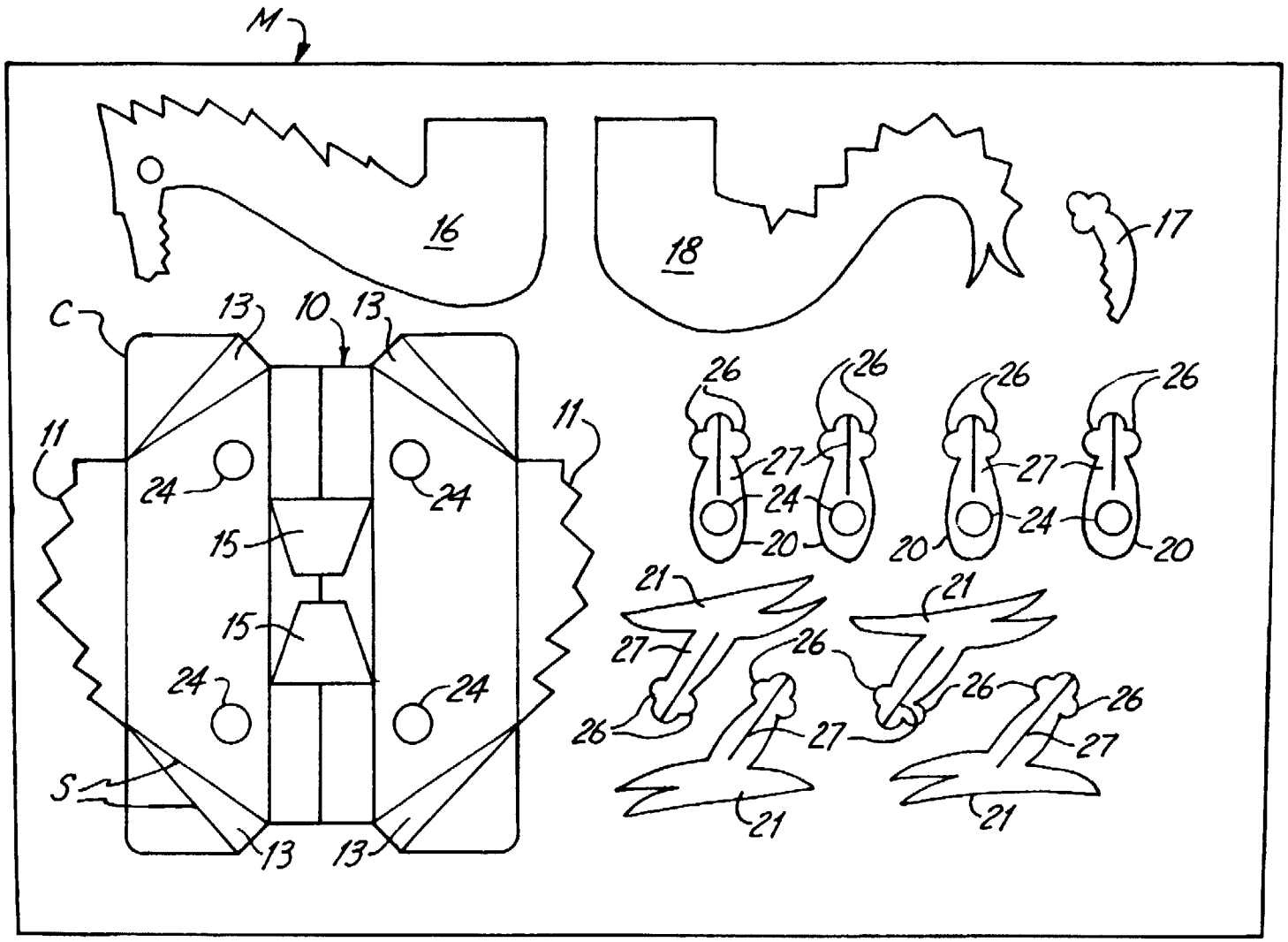
FIG. 4 is a plan view of unassembled and unfolded components of the dragon character of FIG. 1.
Figure 8B:
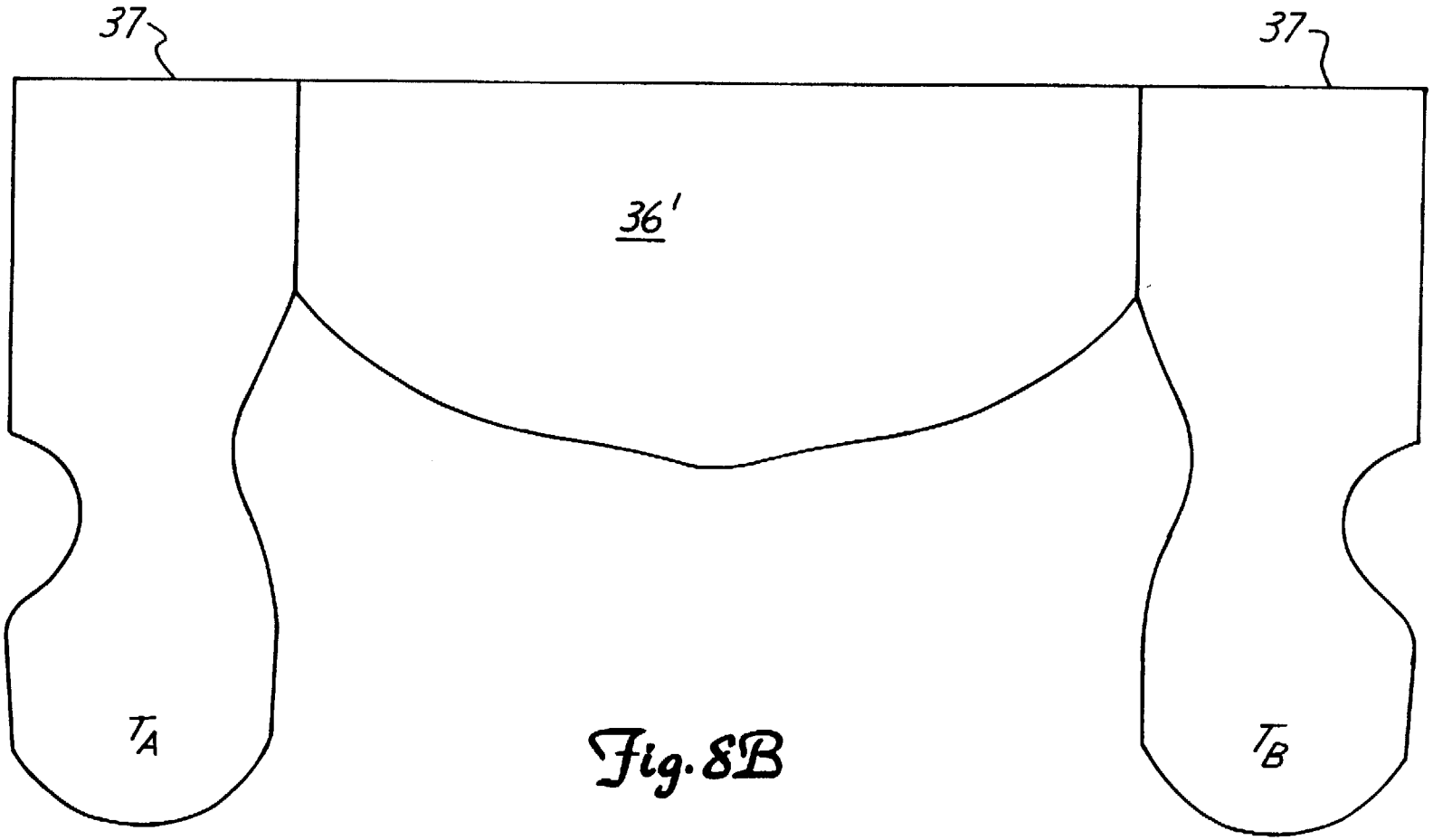
FIG. 8B is a plan view of an unfolded and unassembled three-dimensional head for a human character as in FIG. 8A.

In contrast to the dragon character of FIGS. 1–4, a human character is illustrated in FIGS. 5–10. As best seen in FIGS. 5 and 6, the human character utilizes a folded carton torso member 30 having a generally rectangular shape, with a top portion 32 having sloped faces 34 to represent more life-like shoulders. Sloped faces 34 meet to form a slot 35, for attachment of a head 36. Head 36 is attached to torso 30 by sliding tab "T" of head 36 into slot 35, such that tab "T" also creates a neck for the human character (best seen in FIG. 7). Although FIG. 1 illustrates head 36 as having a flat appearance, other head and neck configurations are possible for human characters. For example, instead of forming head 36 as a flat piece of sheet material with an appropriate profile, the character's head may be provided with a three-dimensional appearance. As seen in FIG. 8A, a cylindrical head 36' (or other appropriate shape) with a flat tab "T" which can be slidably received by slot 35 may be used. FIG. 8B shows the cylindrical head 36' of FIG. 8A in an unfolded and unassembled configuration. The three-dimensional head 36' is created by rolling the flat sheet material into a cylinder and securing neck tab portions $T_A$ and $T_B$ to each other (with tape, adhesive, or the like) to form a supporting structure 37 within cylindrical head 36'.

The human character further includes upper arms 38, forearms 39, upper legs 40 and lower legs 41 which are formed from flat sheet material. Upper arms 38 and upper legs 40 are connected to the torso 30 by the novel joint 22 as described above for the dragon character, while forearms 39 and lower legs 41 are pivotally attached to upper arms 38 and upper legs 40, respectively.

Figure 9:
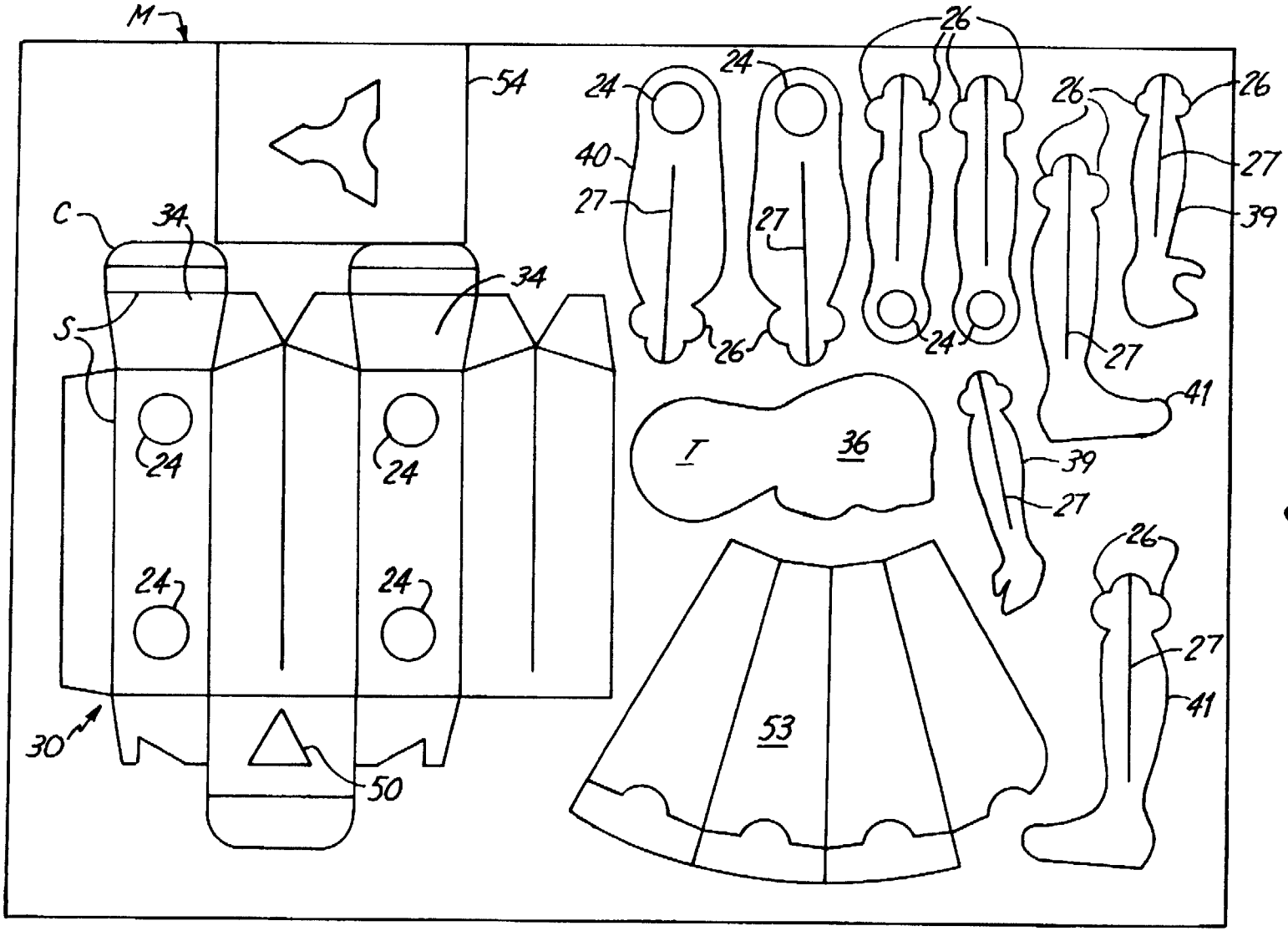
FIG. 9 is a plan view of unassembled and unfolded components of the human character of FIG. 5 having a rectangularly-shaped torso.

The elements of the human character of FIG. 5 are shown in FIG. 9 as they would be laid out on a sheet of material "M" for a die-cutting operation. As described above with reference to the dragon character, the toy is assembled by cutting out the various elements assembling the folded carton torso 30, and attaching the various limbs secured to the torso 30.

It should be recognized that the folded carton torso 30 may take on a variety of shapes. The folded carton torso member 30 may be formed in any shape which approximates the torso of the character to be represented. For example, if a human torso having a rectangular cross-section is not desired, the torso member 30 of the human character could be formed with any number of cross-sectional shapes, such as a cylindrical shape. As an example, FIG. 10 shows an uncut and unassembled human character similar to that in FIG. 9, but having a cylindrical torso member 30' and shoulders 34'. Cylindrical torso 30' is assembled by rolling the sheet material into a cylinder and securing the carton with tabs 42, adhesive, or the like. Shoulders 34' are positioned adjacent an end of torso 30' and tabs 44 are secured to torso 30'. Shoulders 34' are provided with a slot 35' for receiving tab "T" of head 36.

Additional features may be added to the characters to increase their play value. As seen in FIGS. 5 and 6, the play value of the character may be increased by providing the torso member 30 of the human character with a triangular opening 50 opposite head 36. The opening 50 fits a mating stand 52 included with each character. When assembled, the stand 52 comprises a pyramidal mounting device 53 on a base 54 which interacts with the triangular opening 50 in the character's torso 30 to allow the character to rest on the stand 52 for display purposes while its limbs are posed in various manners as illustrated in FIG. 5. Although the triangular shape of opening 50 and mating stand 52 is preferred for ease of construction, alternatively shaped stands, such as rectangular or circular, are also possible and are considered within the scope of the present invention.

Finally, many other types of characters may be created using the folded carton torso and novel joint of the present application. As an example, FIG. 11 depicts an unassembled and unfolded dinosaur character, having a torso 62, head and neck 63, tail 64, and legs 65. The dinosaur character of FIG. 11 is similar in construction to the dragon character of FIGS. 1–4, and like elements are similarly numbered. Finally, FIG. 12 illustrates a cartoon character having torso and head 66, legs 67, and arms 68. The chartoon character of FIG. 12 includes an opening 50 for use with a support stand 52 (not shown) as described above in reference to the human charcter in FIGS. 5–10. The support stand 52 could be cut from a separate sheet of material, for example, or shared with another charcter in a set of multiple characters. The characters of FIG. 11 and 12 are assembled as described for the dragon and human characters, and like elements carry similar reference numerals. As can clearly be seen, the folded carton torso and novel joint of the present application provide a wide variety of play characters, limited only by the designers imagination.

Accordingly, although the present invention has been described with reference to preferred embodiments, workers skilled in the art will recognize that changes may be made in form and detail without departing from the spirit and scope of the invention.

What is claimed is:

1. A toy character comprising:

a torso formed of sheet material, the torso having a plurality of spaced circular openings;

a plurality of appendages formed of sheet material, each appendage being pivotally connected to the torso at one of the circular openings, each appendage including:

a proximal end;

a distal end;

a head at the proximal end for engaging the circular opening, the head having first, second and third tabs, the first and third tabs located on opposite sides of the second tab and extending into the circular opening while the second tab does not extend through the circular opening; and a longitudinal crease which bisects the second tab and extends generally along a center of the appendage from the proximal end toward the distal end.

2. The toy character of claim 1 wherein the plurality of appendages include first and second leg members.

3. The toy character of claim 2 wherein the plurality of appendages include third and fourth leg members.

4. The toy character of claim 2 wherein the plurality of appendages include first and second arm members.

5. The toy character of claim 1 wherein the plurality of appendages are articulated.

6. The toy character of claim 1 wherein the torso comprises a three dimensional folded carton.

7. The toy character of claim 6 wherein the three dimensional folded carton includes a pair of opposed folded flaps, each flap having a first portion and a second portion, the flaps being folded so that the first portions are adjacently positioned and the second portions extend into the carton to define a slot between the second portions.

8. The toy character of claim 7 and further comprising:

a character head formed of sheet material and having a tab which is inserted into the slot and held between the second portions of the flaps.

9. The toy character of claim 7 and further comprising:

a character tail formed of sheet material and having a tab which is inserted into the slot and held between the second portions of the flaps.

10. The toy character of claim 1 wherein the torso has an opening in a lower surface of the torso, and further comprising:

a stand formed of folded sheet material for supporting the torso, the stand having an upper end which is insertable into the opening in the lower surface of the body member.

11. A toy character comprising:

a torso formed of sheet material, the torso having first and second circular openings on opposite sides of the torso;

a first upper leg formed of sheet material and pivotally connected to the torso at the first circular opening, the first upper leg including:

a proximal end;

a distal end;

a head at the proximal end for engaging the first circular opening, the head having first, second and third tabs, the first and third tabs located on opposite sides of the second tab and extending into the first circular opening while the second tab does not extend through the first circular opening;

a longitudinal crease which bisects the second tab and extends generally along a center of the first upper leg from the proximal end toward the distal end; and a distal circular opening adjacent the distal end;

a first lower leg formed of sheet material and pivotally connected to the first upper leg at the distal circular opening, the first lower leg including:

a proximal end;

a distal end;

a head at the proximal end for engaging the distal circular opening of the first upper leg, the head having first, second, and third tabs, the first and third tabs located on opposite sides of the second tab and extend into the distal circular opening of the first upper leg while the second tab does not extend through the distal circular opening; and a longitudinal crease which bisects the second tab and extends generally along a center of the first lower leg from the proximal end toward the distal end;

a second upper leg formed of sheet material and pivotally connected to the torso at the first circular opening, the second upper leg including:

a proximal end;

a distal end;

a head at the proximal end for engaging the second circular opening, the head having first, second and third tabs, the first and third tabs located on opposite sides of the second tab and extending into the second circular opening while the second tab does not extend through the second circular opening;

a longitudinal crease which bisects the second tab and extends generally along a center of the second upper leg from the proximal end toward the distal end; and a distal circular opening adjacent the distal end;

a second lower leg formed of sheet material and pivotally connected to the second upper leg at the distal circular opening, the second lower leg including:

a proximal end;

a distal end;

a head at the proximal end for engaging the distal circular opening of the second upper leg, the head having first, second, and third tabs, the first and third tabs located on opposite sides of the second tab and extend into the distal circular opening of the second upper leg while the second tab does not extend through the distal circular opening; and a longitudinal crease which bisects the second tab and extends generally along a center of the second lower leg from the proximal end toward the distal end.

12. The toy character of claim 11 wherein the torso further includes third and fourth circular openings on opposite sides of the torso.

13. The toy character of claim 12 and further comprising:

a third upper leg formed of sheet material and pivotally connected to the torso at the third circular opening, the third upper leg including:

a proximal end;

a distal end;

a head at the proximal end for engaging the third circular opening, the head having first, second and third tabs, the first and third tabs located on opposite sides of the second tab and extending into the third circular opening while the second tab does not extend through the third circular opening;

a longitudinal crease which bisects the second tab and extends generally along a center of the third upper leg from the proximal end toward the distal end; and a distal circular opening adjacent the distal end;

a third lower leg formed of sheet material and pivotally connected to the third upper leg at the distal circular opening, the third lower leg including:

a proximal end;

a distal end;

a head at the proximal end for engaging the distal circular opening of the third upper leg, the head having first, second, and third tabs, the first and third tabs located on opposite sides of the second tab and extend into the distal circular opening of the third upper leg while the second tab does not extend through the distal circular opening; and a longitudinal crease which bisects the second tab and extends generally along a center of the third lower leg from the proximal end toward the distal end;

a fourth upper leg formed of sheet material and pivotally connected to the torso at the fourth circular opening, the fourth upper leg including:

a proximal end;

a distal end;

a head at the proximal end for engaging the fourth circular opening, the head having first, second and third tabs, the first and third tabs located on opposite sides of the second tab and extending into the fourth circular opening while the second tab does not extend through the fourth circular opening;

a longitudinal crease which bisects the second tab and extends generally along a center of the fourth upper leg from the proximal end toward the distal end; and a distal circular opening adjacent the distal end;

a fourth lower leg formed of sheet material and pivotally connected to the fourth upper leg at the distal circular opening, the fourth lower leg including:

a proximal end;

a distal end;

a head at the proximal end for engaging the distal circular opening of the fourth upper leg, the head having first, second, and third tabs, the first and third tabs located on opposite sides of the second tab and extend into the distal circular opening of the fourth upper leg while the second tab does not extend through the distal circular opening; and a longitudinal crease which bisects the second tab and extends generally along a center of the fourth lower leg from the proximal end toward the distal end.

14. The toy character of claim 12 and further comprising:

a first upper arm formed of sheet material and pivotally connected to the torso at the third circular opening, the first upper arm including:

proximal end;

a distal end;

a head at the proximal and for engaging the third circular opening, the head having first, second and third tabs, the first and third tabs located on opposite sides of the second tab and extending into the third circular opening while the second tab does not extend through the third circular opening;

a longitudinal crease which bisects the second tab and extends generally along a center of the first upper arm from the proximal end toward the distal end; and a distal circular opening adjacent to the distal end;

a first lower arm formed of sheet material and pivotally connected to the first upper arm at the distal circular opening, the first lower arm including:

a proximal end;

a distal end;

a head at the proximal end for engaging the distal circular opening of the first upper arm, the head having first, second and third tabs, the first and third tabs located on opposite sides of the second tab and extend into the distal circular opening of the first upper arm while the second tab does not extend through the distal circular opening; and a longitudinal crease which bisects the second tab and extends generally along a center of the first lower arm from the proximal end toward the distal end;

a second upper arm formed of sheet material and pivotally connected to the torso at the fourth circular opening, the second upper arm including:

a proximal end;

a distal end;

a head at the proximal end for engaging the fourth circular opening, the head having first second, and third tabs, the first and third tabs located on opposite sides of the second tab and extending into the fourth circular opening while the second tab does not extend through the fourth circular opening;

a longitudinal crease which bisects the second tab and extends generally along a center of the second upper arm from the proximal end toward the distal end; and a distal circular opening adjacent the distal end;

a second lower arm formed of sheet material and pivotally connected to the second upper arm at the distal circular opening, the second lower arm including:

a proximal end;

a distal end;

a head at the proximal end for engaging the distal circular opening of the second upper arm, the head having first, second and third tabs, the first and third tabs located on opposite sides of the second tab and extend into the distal circular opening of the second upper arm while the second tab does not extend through the distal circular opening; and a longitudinal crease which bisects the second tab and extends generally along a center of the second lower arm from the proximal end toward the distal end.

15. The toy character of claim 14 wherein the first and second upper arms each include a transverse fold to create a shoulder.

16. The toy character of claim 11 wherein the torso comprises a three dimensional folded carton.

17. The toy character of claim 16 wherein the three dimensional folded carton includes a pair of opposed folded flaps, each flap having a first portion and a second portion, the flaps being folded so that the first portions are adjacently positioned and the second portions extend into the carton to define a slot between the second portions.

18. The toy character of claim 17 and further comprising:

a character head formed of sheet material and having a tab which is inserted into the slot and held between the second portions of the flaps.

19. The toy character of claim 17 and further comprising:

a character tail formed of sheet material and having a tab which is inserted into the slot and held between the second portions of the flaps.

20. The toy character of claim 11 wherein the torso has an opening in a lower surface of the torso, and further comprising:

a stand formed of folded sheet material for supporting the torso, the stand having an upper end which is insertable into the opening in the lower surface of the body member.

* * * * *

UNITED STATES PATENT AND TRADEMARK OFFICE

CERTIFICATE OF CORRECTION

PATENT NO. : 5,775,971

DATED : JULY 7, 1998

INVENTOR(S) : JERRY L. BROWN

It is certified that error appears in the above-identified patent and that said Letters Patent is hereby corrected as shown below:

Col. 9, line 66 , before "proximal" insert --a--

Col. 10, line 33, after "first" insert --,--

Signed and Sealed this

Twenty-ninth Day of August, 2000

*Attest:*

*Attesting Officer*

Q. TODD DICKINSON

*Director of Patents and Trademarks*